US008344230B2

(12) United States Patent
Rahe

(10) Patent No.: US 8,344,230 B2
(45) Date of Patent: Jan. 1, 2013

(54) METHOD FOR IMPROVING THE SOUND OF MUSICAL INSTRUMENTS

(75) Inventor: Hans-Ulrich Rahe, Bad Salzdetfurth (DE)

(73) Assignee: Steinway & Sons, New York, NY (US)

( * ) Notice: Subject to any disclaimer, the term of this patent is extended or adjusted under 35 U.S.C. 154(b) by 586 days.

(21) Appl. No.: 12/439,818

(22) PCT Filed: Aug. 29, 2007

(86) PCT No.: PCT/EP2007/058977

§ 371 (c)(1),
(2), (4) Date: Mar. 3, 2009

(87) PCT Pub. No.: WO2008/028846

PCT Pub. Date: Mar. 13, 2008

(65) Prior Publication Data

US 2009/0320666 A1 Dec. 31, 2009

(30) Foreign Application Priority Data

Sep. 4, 2006 (EP) ..... 06018420

(51) Int. Cl.
*G10C 3/06* (2006.01)

(52) U.S. Cl. ..... 84/192

(58) Field of Classification Search ..... 84/192–195, 84/312 R, 313, 307–311
See application file for complete search history.

(56) References Cited

U.S. PATENT DOCUMENTS

| | | | | |
|---|---|---|---|---|
| 59,204 | A | 10/1866 | Fiske | |
| 2,229,440 | A | 2/1941 | Carlisle | |
| 4,607,559 | A | 8/1986 | Armin | |
| 5,986,190 | A | 11/1999 | Wolff et al. | |
| 6,664,456 | B2 | 12/2003 | Momchilvich | |
| 7,645,354 | B1 * | 1/2010 | DiSanto | 156/153 |
| 2003/0034202 | A1 * | 2/2003 | Zanker | 181/258 |

FOREIGN PATENT DOCUMENTS

| | | | | |
|---|---|---|---|---|
| AT | 176 731 B | | 11/1953 | |
| EP | 0 864 712 | | 9/1998 | |
| EP | 1 913 575 B1 | | 8/2007 | |
| FR | 2 618 589 | | 7/1987 | |
| JP | 01040993 A | * | 2/1989 | 84/182 |
| JP | 2001-303691 | | 10/2001 | |
| JP | 2001303691 A | * | 10/2001 | |

OTHER PUBLICATIONS http://web.archive.org/web/20060112103158.
http://web.archive.org/web/20060205164408.
http://www.stankiewicz.de/images/baryx.pdf.
http://www.bauphysik.de/lehre/tu-muencehen-kr/7-alcustik.pdf.
International Search Report in corresponding application PCT/EP2007/058980 dated Oct. 25, 2007.
International Search Report in corresponding application PCT/EP2007/058977 dated Nov. 16, 2007.

* cited by examiner

*Primary Examiner* — Kimberly Lockett
(74) *Attorney, Agent, or Firm* — Fish & Richardson P.C.

(57) ABSTRACT

The invention relates to a method for improving the sound of acoustic musical instruments by decoupling the part of a musical instrument that is directly responsible for producing the primary sound event from the elements and components that are not directly involved in producing the primary sound event. The limitation of the acoustically active part prevents elements (6, 7) that have primarily static or optical functions or serve to produce variety of playing technique from vibrating or emitting sound, since they may lead to interferences and distortions of the primary sound event. According to the invention, an intermediate layer produced from a material (1) that reduces sound conduction is arranged in the connecting zones between the elements.

6 Claims, 5 Drawing Sheets

METHOD FOR IMPROVING THE SOUND OF MUSICAL INSTRUMENTS

TECHNICAL FIELD

The invention relates to a method for improving the sound of musical instruments. It particularly relates to a method for reducing sound conduction between components of musical instruments. Finally, a new type of musical instrument is also indicated with the invention.

In the sense of this invention, the "passive region" of a musical instrument is to be understood as those components or regions of components that are not directly required for generation of sound. Examples of such components are, for example in the case of a grand piano or upright piano: the cast iron plate on which the strings are strung; in the case of a violin: the neck; in the case of a kettledrum: the corpus on which the membrane is stretched, etc.

In contrast to this, the "active region" of a musical instrument in the sense of this invention is understood to mean those components or regions of components that are directly necessary for sound production, such as the strings of a piano/grand piano, or of a violin, the reed of a clarinet, etc.

Furthermore, the terms "primary sound event" and "secondary sound event" will be used below to explain the invention, and are to be understood as follows: A primary sound event is one that is brought about by the vibrations of the components of the active region or of the active region of a component, in other words the sound event that is actually intended, in the foreground, for the sound of the musical instrument. In contrast, the secondary sound event is understood to be the sound event produced by vibrations of the components of the passive region of the musical instrument, which helps to co-determine the overall sound, as the result of superimposition on the primary sound event.

STATE OF THE ART

In traditional instrument construction, the influence of secondary sound events on the primary sound event is understood to be an essentially unavoidable, integral part of the overall sound.

Explained using the example of pianos and grand pianos (see FIGS. 1 and 2), this means: The soundboard 13 is connected with the rest of the corpus (grand piano frame or inner rim 6 and wall or outer rim 7), and in this way with all the components of the instrument, in a sound-conducting manner. This means that all the parts of the instrument are excited to vibrate by means of the primary sound event, i.e. by the vibrations of the active region, which consists of strings, bridge 14, and soundboard 13.

The same fundamental principle also applies predominantly for all other musical instruments: in the case of bowed and plucked instruments, for example, because of the sound-conducting connection of the soundboard with the frame and the instrument neck; in the case of wind instruments, because of the sound-conducting connection of the mouthpiece with the corpus (barrel); in the case of percussion instruments, because the membrane is stretched onto a frame, which in turn is connected with the corpus in sound-conducting manner, etc.

As a result, very complex interference patterns and phase shifts come about, resulting from running time differences and different resonance characteristics of the individual components. The end result is an overall sound for which it holds true that, while it is dominated by the primary sound event emitted by the soundboard 13, in the case of a grand piano, for example, its undistorted purity, clarity, and dynamics are distorted, covered up, and blurred by the numerous, complex interferences.

There have been attempts, again and again, particularly in piano and grand piano construction, to reduce annoying sound events. For example, the cast iron plate 5 was provided with large sound openings, for example, and an attempt was made to eliminate cast iron plate ribs. Grand piano casters 11 or coasters were specially designed (in most cases as spring or air cushion systems), in order to uncouple the grand piano from the floor. However, in all these efforts, all the components of the upright piano or grand piano have fundamentally remained connected with one another, in sound-conducting manner, up to the present. Measures for decoupling that region of a musical instrument that produces the primary sound event from all the components that do not serve to produce the primary sound event, so that these are not put into vibration, have not been and are not being routinely made in musical instruments up to the present. In expert circles, material and housing (i.e. case, corpus, or body) resonances are considered to be a characteristic component of the overall sound of every instrument.

Secondary noises, for example those brought about by moving keys and mechanical parts, have been and are routinely fought, up to the present, only at the location where they occur. Traditional measures for reducing mechanical noises are the use of softer or thicker felt buffers, softer or thicker leather cushions, and the like. The residual noise that is still present is then considered to be an unavoidable component of the sound.

In the case of a grand piano, for example, the main function of the keybed or action table 9 is to ensure a shape-stable support for the key mechanism. Static aspects dominate the different embodiments; up to now, undesirable reinforcement of mechanical noises (or, to put it better, their prevention) has not played a role. The same holds true for the grand piano top 8: Shape stability of the panel surface determines the layer structure, in order to obtain a good surface for the high-gloss polyester paint. Up to now, the secondary sound radiation of a top that is coupled with the remainder of the instrument and is therefore excited to vibrate with it has not played any role in the layer construction. The interferences with the primary sound event that result from the inherent vibration behavior of the top, on the one hand, and the influence of the undesirably vibrating top on the primary signal emitted by the soundboard and reflected to the listener by the raised top have been knowingly or unknowingly accepted up to now. To the present date, there are no grand pianos in which this is prevented in a manner similar to that described below in connection with musical instruments in general.

Exceptions from this rule have been described in individual cases. In this connection, materials having low sound impedance, in other words low sound velocities and low densities, are used for reducing the sound conduction, in other words for decoupling. For example, resiliently elastic materials such as foam rubber are used.

For example, a violin is known from U.S. Pat. No. 4,607,559 (Armin Richard (CA)), 1986-98-26, the soundboard of which is uncoupled from the violin body by means of STYROFOAM. Here, the sound conduction is reduced in skilled manner, by means of the use of an unsuitable material. Accordingly, a material having a lower characteristic sound impedance, in other words a material having a low sound velocity and low density, is used.

Analogously, GB 2285848 (Boosey & Hawkes Musical Instr (GB)), 1995-07-26, uses loosely inserted, resiliently elastic materials having thin lips to damp vibrations of the return springs of brass instruments.

It is therefore known to a person skilled in the art to achieve decoupling of different parts—to the extent that this is even considered—by means of using the difference in characteristic sound impedance between materials introduced for decoupling and the original parts of a musical instrument. For this purpose, materials having a low characteristic sound impedance, in other words low sound velocity and low density, such as STYROFOAM, for example (density approximately $4\times10^{-8}$ g/cm$^3$) are used.

However, the stated attempts have not lead to any significant improvement in the sound of the previously known musical instruments.

PRESENTATION OF THE INVENTION

It is therefore the task of the invention, in order to achieve a significant improvement in the sound of musical instruments, to indicate a method with which the annoying influence of secondary sound events, which are produced as the result of sound conduction passed on within the musical instrument, between different components, is reduced to the primary sound event.

This task is surprisingly accomplished, in a method aspect, by means of a method in which, according to claim 1, materials having a density of at least 2.0 g/cm$^3$, particularly more than 2.4 g/cm$^3$ and a sound velocity of less than 150 m/s are used to reduce the sound conduction. Advantageous further developments of the method are indicated in the dependent claims 2 to 4. The uses of a material having a density of more than 2.4 g/cm$^3$ and a sound velocity of less than 150 m/s are the object of claims 5 to 8. Finally, in claims 9 and 10, musical instruments according to the invention are claimed.

Kinetic decoupling is therefore achieved by means of the targeted use of materials having a sound velocity that is clearly less than the velocity of sound in air, at 340 m/s, particularly having a sound velocity of less than 150 m/s, and having a density of more than 2.4 g/cm$^3$. The material used for kinetic uncoupling must always have a lower sound velocity than the components to be decoupled from one another.

In contrast to the method of procedure known from the state of the art, the present invention describes concrete measures and the use of specific materials, which lead to the result that the primary sound event is emitted without distortion and without the influence of interferences, in that the transfer of the sound energy into the components whose vibrations and sound emission are not necessary or desirable is reduced to a minimum by means of decoupling. Furthermore, sound events that are being generated by secondary sound sources (e.g. key noises or mechanical noises) can also be limited, in terms of the spread, to the component in which they are formed.

The kinetic decoupling of the components, according to the invention, by means of the intermediate layer of the material that prevents sound conduction, which will be referred to as "kinetic decoupling" within the scope of this application, brings about a restriction of the original primary sound event, brought about by the primary vibration exciter, to a clearly defined local region, which will be referred to in this connection as an active region having the active components. The passive components of a musical instrument stand in contrast to this. The region of these passive components will be called the passive region, to distinguish it from the sound-producing, active region, since passive components must fulfill different functions (statics, method of playing, optics, and the like).

The kinetic decoupling brought about according to the invention therefore means that no transition of the primary sound event out of the active region into the other, passive regions of the instrument takes place. Furthermore, in the case of instruments set up on the floor of the space, in each instance (concert hall, podium, and the like), coupling of the instrument in terms of sound by way of the legs, casters, supports, or the like, to the floor is avoided. Also, those components of a musical instrument in which sound events that fundamentally annoy the desired sound are produced (for example, mechanical noises in the console of a grand piano or piano), can be insulated, in terms of coupling of sound, from the remaining components, in order to minimize radiation of the annoying sound event and thus its influence on the overall sound of the instrument.

A heavy, flexible plastic layer that is easy to bend, containing inorganic fillers, such as that offered for sale by the company Stankiewicz GmbH in Adelheidsdorf, Germany, under the name "Bary-X," will be mentioned as an example for a material suitable for kinetic decoupling in the sense of the invention; it has a sound velocity of approximately 60 m/s and, at a thickness of 3 mm, a weight per unit area of 8 kg/m$^2$ (or, at a thickness of 6 mm, a weight per unit area of 16 kg/m$^2$). "Bary-X" possesses a density between 2.45 g/cm$^3$ and 2.7 g/cm$^3$, according to the publicly accessible EC safety data sheet, and thus possesses a characteristic sound impedance between approximately 147,000 Ns/m$^3$ and approximately 162,000 Ns/m$^3$.

Such a panel can be inserted (for example glued in), in the case of a piano or grand piano, for example, at a connection point between an active and a passive component, in order to achieve complete decoupling of the components or regions, in each instance.

Use of the material that suppresses sound conduction, according to the invention, as indicated in claim 7, in an intermediate layer in the case of a multi-layer structure of a component of a musical instrument, leads to "acoustical quieting" of this component. This means that the component is not excited to vibrate on its own, either by vibrations passed on by way of the instrument body, or by air sound that impacts it, and thus cannot trigger any secondary sound event that disrupts the primary sound event. For example, such a structure can be chosen for the top of a grand piano, in order to stop its resonance, which is fundamentally annoying.

In the following, the invention will be explained once again, in greater detail, with its advantages and characteristics, using an exemplary embodiment and making reference to the attached figures. These show:

WAY(S) FOR IMPLEMENTING THE INVENTION

Figure 1:
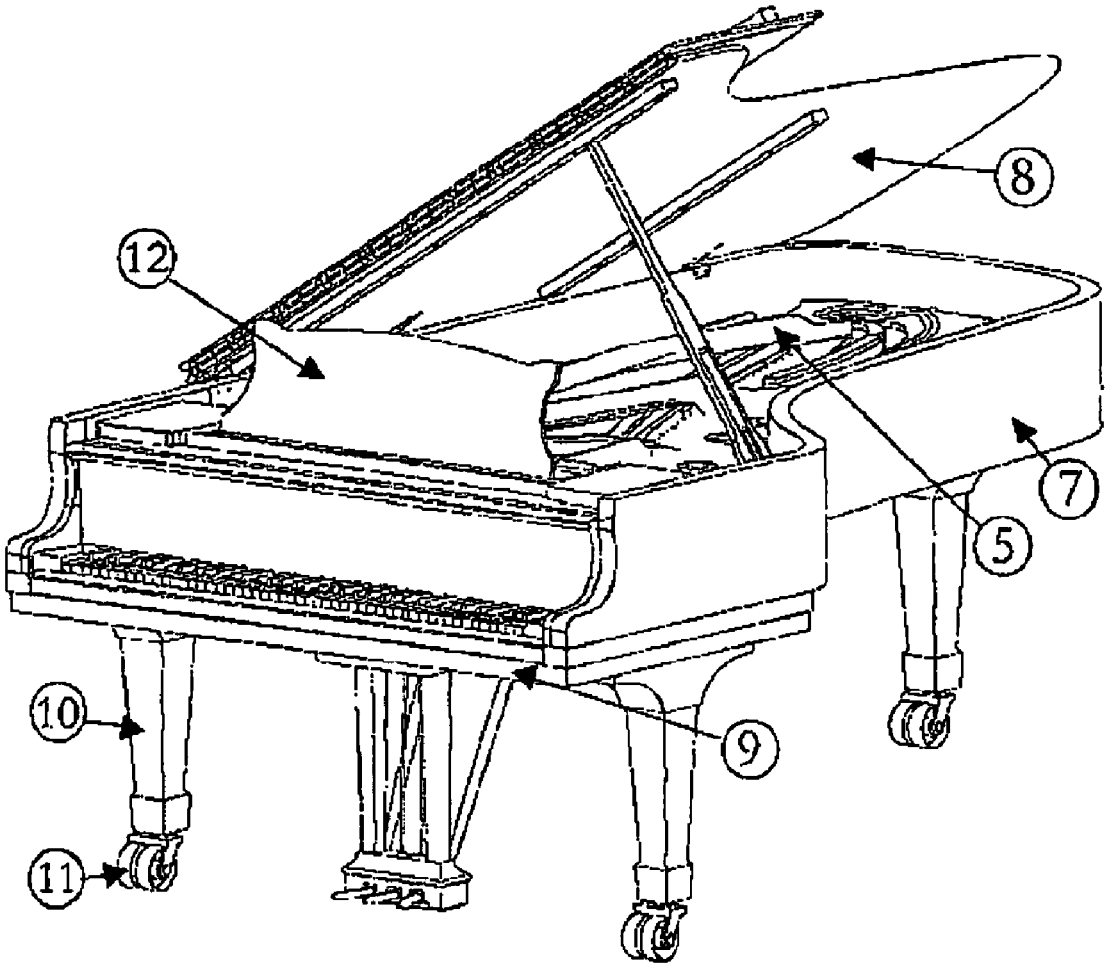
FIG. 1, a three-dimensional representation of a grand piano as a possible musical instrument for application of the method according to the invention.
Figure 2:
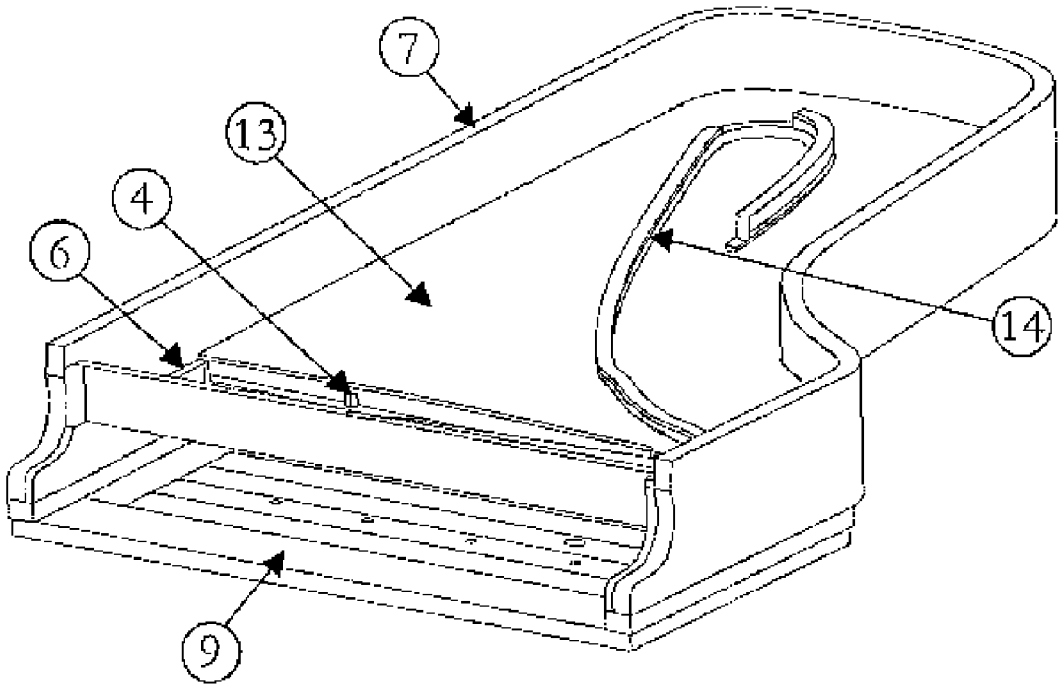
FIG. 2, a representation of the corpus of the grand piano shown in FIG. 1.

FIGS. 1 and 2 show a grand piano, i.e. its corpus, in isolated manner, as a possible musical instrument for application of the method according to the invention.

The grand piano consists of the central main component, the rim, consisting of the outer rim 7 and the inner rim 6, which is set up on legs 10 with casters 11 attached to them, and closed off at the top side with a top 8. On the front of the rim, there is the keybed or action table 9, on the underside, on which the mechanism required to strike the strings, consisting of a claviature (keyboard) and a mechanical system, is situated. In the rim, as the central component, there is the soundboard 13 that is glued onto the inner rim 6 and usually consists of spruce wood, with the cast iron plate 5 that lies above it, which usually consists of gray cast iron, onto which the strings are strung, and, underneath it, the braces that reinforce the corpus. The connection between fibs braces and cast iron plate 5 consists of a case wedge 4; the connection of strings and soundboard 13 takes place by means of the bridge 14 that is firmly connected with the soundboard 13. In the front upper part of the grand piano, there is the music desk 12.

The primary sound event, i.e. the desired tone event, is produced, in the case of pianos and grand pianos, by means of vibrating strings, for example, transferred to the soundboard 13 by the bridge 14, and reinforced by the former. Thus, the active region of pianos and grand pianos consists of the strings, the bridges 14, and the soundboard 13 along with all its other components (ribs, crosswise and edge reinforcements, and the like). The passive region is formed by all the other components, i.e. by the instrument corpus (outer rim 7 and inner rim 6), the cast iron plate 5, the top 8, the note stand 12, etc.

Figure 3:
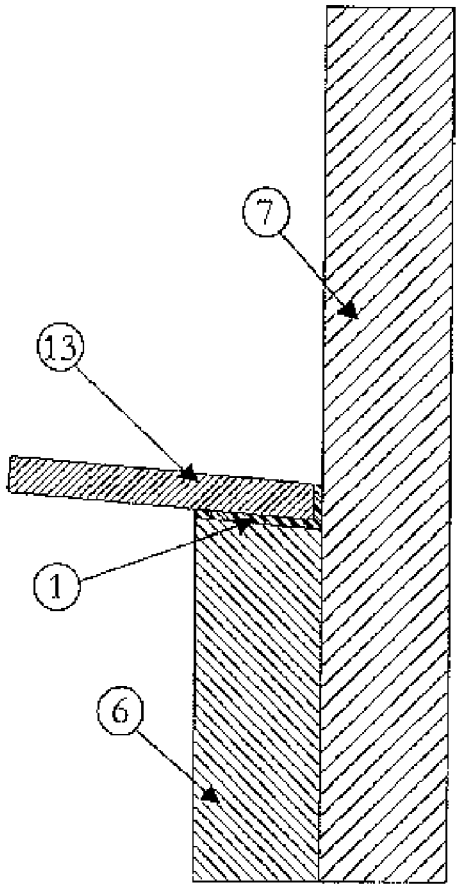
FIG. 3, in a sectional representation, a possible design variant for decoupling the soundboard from the corpus.
Figure 4:
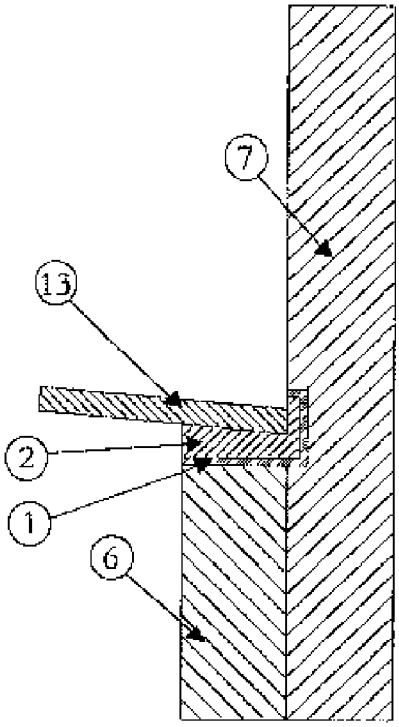
FIG. 4, in a representation analogous to FIG. 3, a design variant with an interposed soundboard bed.
Figure 5:
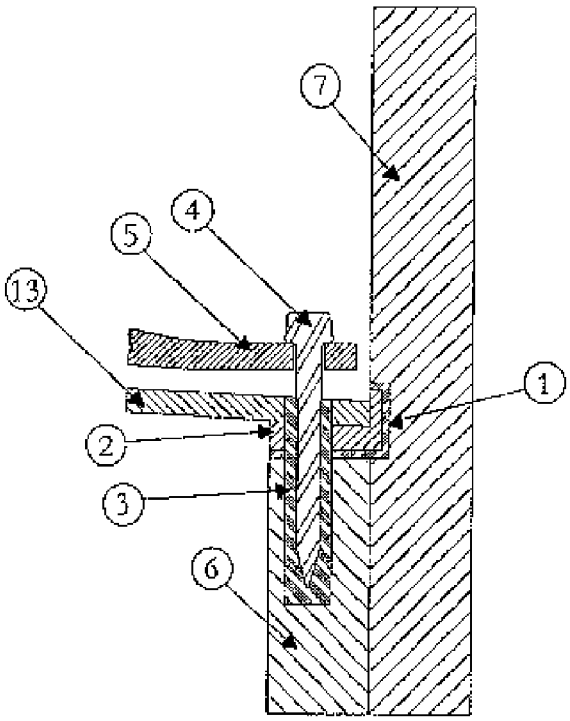
FIG. 5, in a representation analogous to FIG. 3, a design possibility for decoupling a connection element.

Kinetic decoupling of the active region, according to the invention, can take place as enclosed or full embedding of the soundboard 13. Mounting of the soundboard 13 can take place directly on a material suitable for decoupling (see FIG. 3), or by means of decoupling of a partial region of the inner rim 6 onto which the soundboard 13 is glued (see FIG. 4). Furthermore, all the connections, screws, dowels, or other contact points between the active and passive region are placed in a cuff (a "dowel") 3 made of this material (see FIG. 5), in order to achieve sufficient decoupling and to undertake a clear separation between the active and passive region. This means that all the joints of the instrument where a transfer of the primary sound event into the passive region of the instrument is possible—independent of the position and the size of these joints—are decoupled by means of a suitable material.

Figure 6:
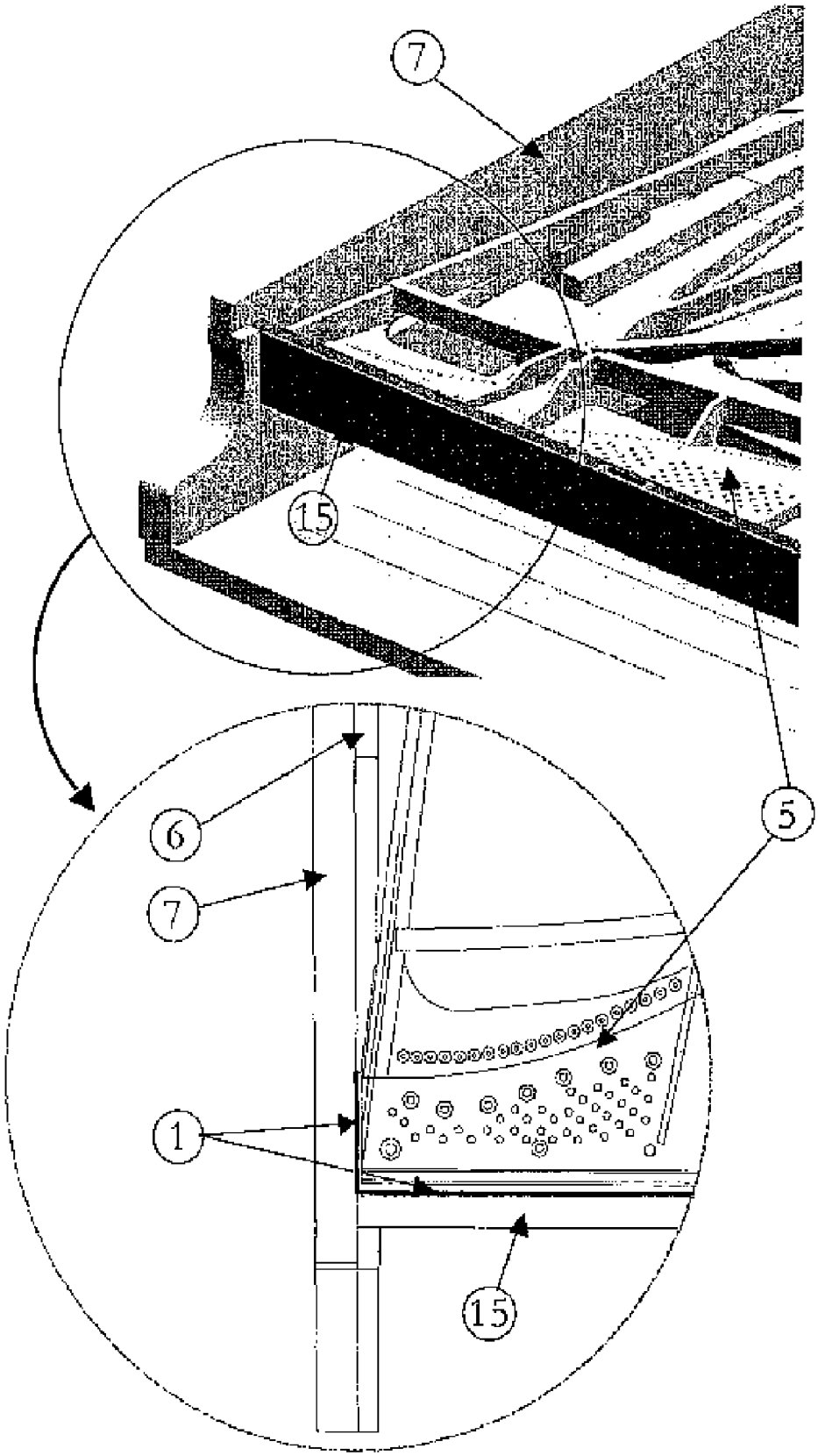
FIG. 6, in a schematic representation, a design possibility for decoupling the console from the remainder of the corpus.

In the case of pianos and grand pianos, the string tension is absorbed by a cast iron plate 5. Because of this function, decoupling of string and cast iron plate 5 is not possible. However, since sound energy can get from the string, through the cast iron plate 5, into all the other components of the instrument, the cast iron plate 5 must also be uncoupled from the remaining passive components of the grand piano (in other words, the sound event that is not desirable in the case of the cast iron plate 5, but is unavoidable, is also limited to the smallest possible, local region). This takes place analogous to the method of procedure for decoupling of the active region, by means of enclosed or full embedding of the cast iron plate 5 into a material 1 that is suitable for kinetic decoupling (see FIG. 5: There, the cast iron plate 5, i.e. the plate edge screw 4, is uncoupled not only from the soundboard 13, but also from the inner rim 6 and the outer rim 7). If the cast iron plate 5, in turn, is supposed to be inseparably connected with other components (such as with the pin block 15), decoupling takes place at the next possible component, in each instance, in order to keep the sum of the components that are not uncoupled, in terms of sound energy, as low as possible (see FIG. 6: Here, decoupling takes place between pin block 15 and outer rim 7 and inner rim 6, since decoupling of cast iron plate 5 and pin block 15 is not possible, for design reasons).

Figure 7:
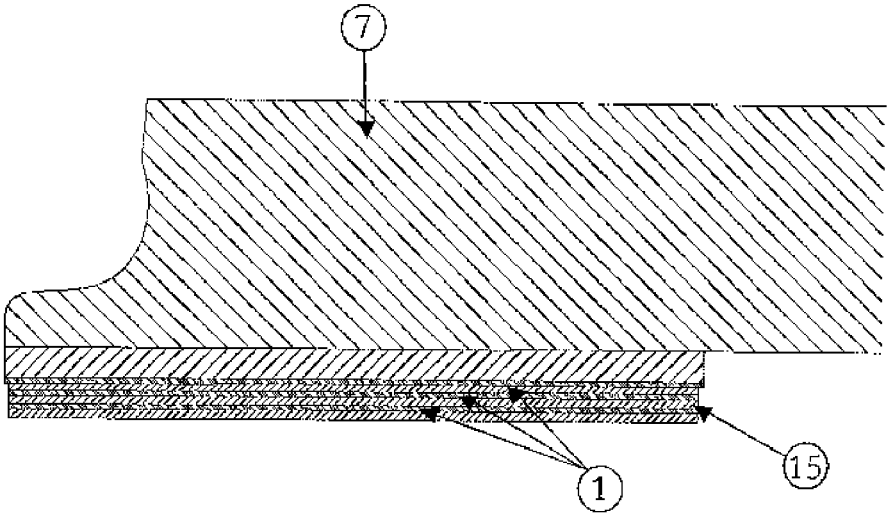
FIG. 7, a possibility of decoupling the keybed from the rest of the housing, according to the invention, in a multi-layer structure.

The keybed 9 (action table) is the primary amplifier of the undesirable secondary sound event "mechanical noises," which is produced by the movement of the keys and the mechanism that lies behind them. In order to locally limit this sound event, i.e. to avoid propagation of the sound energy of the mechanical noises into the entire instrument, here, too, local limiting is undertaken by means of kinetic decoupling of the keybed 9 from inner rim 6, outer rim 7, and the surrounding air, by means of the multi-layer structure of the keybed, in which one or more layers of the material 1 are inserted for decoupling (see FIG. 7). Further possibilities for locally limiting the mechanical noises are made possible by working a material 1 for decoupling into the keyboard frame, mounting the mechanism frame or the keyboard frame on this material, and the like.

The analogous method of procedure is possible and desirable, for reasons in terms of sound, for other case parts in which undesirable coupling, resonance phenomena, or amplifications of secondary noises can occur, such as the top 8, music desk 12, upper and lower frame, grand piano outer rim 7, and the like.

In the exemplary embodiment described above, the invention was described using a piano or grand piano. Analogous to the method of procedure in the case of these instruments, however, optimization of the sound can be achieved in basically all other musical instruments, as well, by applying the principle of decoupling the active region from the passive region.

In the case of wind instruments that possess a mouthpiece, such as the saxophone, clarinet, oboe, and all instruments that have a cup mouthpiece, this mouthpiece, for example, can be kinetically uncoupled from the instrument corpus (pipe). This measure brings about the result that the air stream that is required and desired for the primary sound event does undergo amplification in the pipe, due to velocity transformation, but the body material (i.e. the corpus) of the wind instrument is not excited to produce secondary, interfering sound.

In the case of bowed and plucked instruments, such as the violin, cello, and guitar, the frame and the neck with the fingerboard, for example, are merely passive components that serve for the playing function and/or stability of the instrument. The connection of the soundboard with the back by means of the sound post is the part actually relevant for sound. For this reason, the frame and the neck can be kinetically uncoupled from the rest of the instrument, in the manner according to the invention (in the case of the cello and contrabass, also the guide of the endpin and the lower end of the endpin from the floor), in order to restrict the primary sound event to the active part.

This method of procedure can be transferred ad libitum to other musical instruments, by means of identifying and consistently kinetically decoupling the active region of an instrument that is required for production of the primary sound event from all the components that do not have a direct sound function, by means of the method claimed below.

REFERENCE SYMBOL LIST

1 material for decoupling
2 soundboard bed

3 dowels made of material for uncoupling
4 plate edge screw
5 cast iron plate
6 inner rim
7 outer rim
8 top
9 keybed (action table)
10 leg
11 caster
12 music desk
13 soundboard
14 bridge
15 pin block

The invention claimed is:

1. A method for reducing sound conduction between components of a musical instrument, the method comprising disposing an intermediate layer of a material that reduces sound conduction at connection points between said components, wherein said material that reduces sound conduction is disposed at only one or more limited regions of the musical instrument, and said material that reduces sound conduction has a density of at least 2.45 g/cm$^3$ to 2.7 g/cm$^3$ and a sound velocity of less than 150 m/s.

2. The method of claim 1, wherein the one or more limited regions of the musical instrument where said material that reduces sound conduction is disposed includes at connection points between active components that are directly required for producing sound and passive components that are non-requisite for producing sound, of said musical instrument.

3. The method of claim 1, wherein the one or more limited regions of the musical instrument where said material that reduces sound conduction is disposed includes at connection points between a said component equipped with mechanically movable elements and an adjacent said component.

4. A method comprising using a material having a density of 2.45 g/cm$^3$ to 2.7 g/cm$^3$ and a sound velocity of less than 150 m/s as an intermediate layer at only one or more limited regions of the musical instrument, including at connection points between components of a musical instrument.

5. A method comprising using a material having a density of 2.45 g/cm$^3$ to 2.7 g/cm$^3$ and a sound velocity of less than 150 m/s in at least one intermediate layer of a multi-layer structure of only one or more limited regions of a component of a musical instrument, for acoustical quieting of said musical instrument.

6. A musical instrument having at least two components, where a material having a density of 2.45 g/cm$^3$ to 2.7 g/cm$^3$ and a sound velocity of less than 150 m/s is interposed at only one or more limited regions of the musical instrument, including at connection points between said two components.

* * * * *